US010612893B2

(12) United States Patent
Bradley

(10) Patent No.: US 10,612,893 B2
(45) Date of Patent: Apr. 7, 2020

(54) VEHICULAR EXTERNAL FORCE ABSORPTION SYSTEMS AND METHODS

(71) Applicant: Southwest Research Institute, San Antonio, TX (US)

(72) Inventor: Joseph Hogan Bradley, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 15/994,253

(22) Filed: May 31, 2018

(65) Prior Publication Data

US 2019/0353466 A1 Nov. 21, 2019

Related U.S. Application Data

(60) Provisional application No. 62/671,864, filed on May 15, 2018.

(51) Int. Cl.
*F41H 7/04* (2006.01)
*F41H 5/013* (2006.01)
*F41H 5/02* (2006.01)

(52) U.S. Cl.
CPC ..... *F41H 7/042* (2013.01); *F41H 5/013* (2013.01); *F41H 5/02* (2013.01)

(58) Field of Classification Search
CPC ..... F41H 7/042; F41H 7/044
USPC ..... 296/187.07, 187.08; 267/69, 73; 89/36.01, 36.04, 36.08, 36.09, 36.11, 89/36.12; 188/371, 376
See application file for complete search history.

(56) References Cited

U.S. PATENT DOCUMENTS 3,908,951 A * 9/1975 Goben ..... F16F 7/123 248/548
5,663,520 A * 9/1997 Ladika ..... F41H 5/226 296/187.07
8,347,775 B2 * 1/2013 Altenhof ..... F16F 7/127 293/128
8,627,757 B2 * 1/2014 Tobie ..... F41H 5/007 89/36.04
9,133,899 B2 * 9/2015 Delage ..... F16F 1/13
9,382,008 B2 * 7/2016 Fornecker ..... B64D 11/0619
9,821,747 B2 * 11/2017 Benedetti ..... F16B 21/086
(Continued)

*Primary Examiner* — Dennis H Pedder
(74) *Attorney, Agent, or Firm* — Grossman, Tucker, Perreault & Pfleger, PLLC

(57) ABSTRACT

The systems and methods described herein provide a vehicular force absorption system that includes an interference damper that couples a vehicle external hull with a vehicle floor that is spaced apart from the vehicle external hull. The interference damper includes a common member having a first breakaway member coupled or connected to a second breakaway member. The coupling or connection between the first breakaway member and the second breakaway member may have a defined yield point at which the first breakaway member separates from the second breakaway member when subjected to a tensile force. The interference damper further includes a plurality of curved members that provide a resistive force against the separation of the first breakaway member and the second breakaway member. The resistive force provided by the interference damper beneficially reduces the force exerted on personnel and/or cargo in contact with the vehicle floor.

12 Claims, 8 Drawing Sheets

(56) References Cited

U.S. PATENT DOCUMENTS

2010/0307329 A1* 12/2010 Kaswen ..... F16F 9/06
89/36.08

* cited by examiner

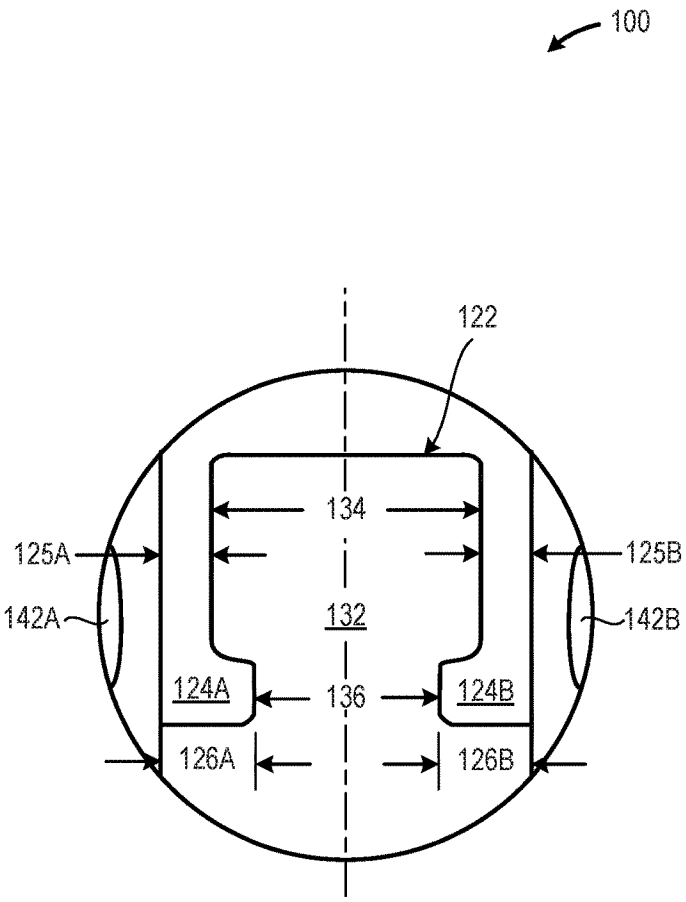
FIG. 1C
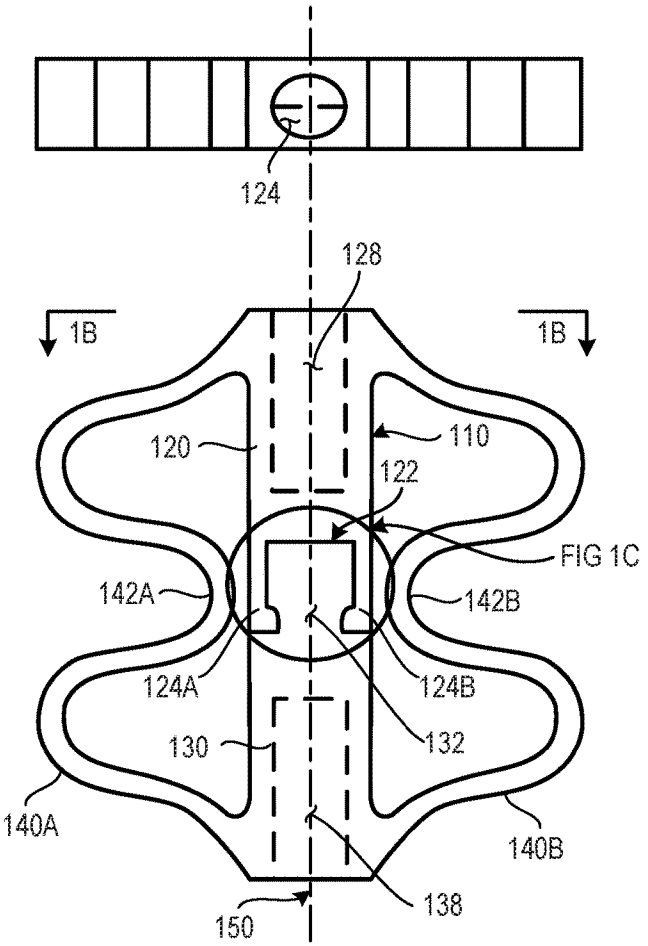
FIG. 1B
FIG. 1A

VEHICULAR EXTERNAL FORCE ABSORPTION SYSTEMS AND METHODS

CROSS-REFERENCE TO RELATED APPLICATIONS

The present application claims the benefit of the filing date of U.S. Provisional Application Ser. No. 62/671,864, filed May 15, 2018, which is incorporated by reference in its entirety.

GOVERNMENT SUPPORT CLAUSE

This invention was made with government support under National Advanced Mobility Consortium (NAMC) Agreement No. 69-201501 TO1 funded by Prime Contract No. W15QKN1491002 awarded by US Army TARDEC. The government has certain rights in the invention.

TECHNICAL FIELD

The present disclosure relates to vehicular components, more specifically to mitigating the effects of an externally applied force on the internal contents of a vehicle.

BACKGROUND

During underbody blast events in military vehicles, the forces applied to the external hull of the vehicle may cause the hull to accelerate rapidly upward. The forces associated with the sudden upward acceleration of the vehicle floor are sufficient to cause injuries or death to vehicle occupants and/or damage to cargo carried by the vehicle. Prior solutions have included electronic energy absorption systems that detect the force of an explosion and compensate accordingly. Such electronic systems are cumbersome, expensive, and maintenance intensive—detrimental factors when vehicles are required to operate in remote locations over oftentimes rugged terrain. Other solutions have included shear pins or similar devices that fail under load. Such shear pin based systems are imprecise and have been found to suffer damage that impacts the ultimate failure load on the pin when vehicles are operated on unimproved or rugged terrain.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

FIG. 1A is an elevation of an illustrative interference damper having a central member that includes a first breakaway member connected to a second breakaway member, a first curved member coupled to the central member and a second curved member coupled to the central member, in accordance with at least one embodiment described herein;

FIG. 1B is a plan view of the illustrative interference damper depicted in FIG. 1A along sectional line 1B-1B, in accordance with at least one embodiment described herein;

FIG. 1C is an enlarged view of the connection or coupling between the first breakaway member and the second breakaway member 130, in accordance with at least one embodiment described herein;

Figure 2:
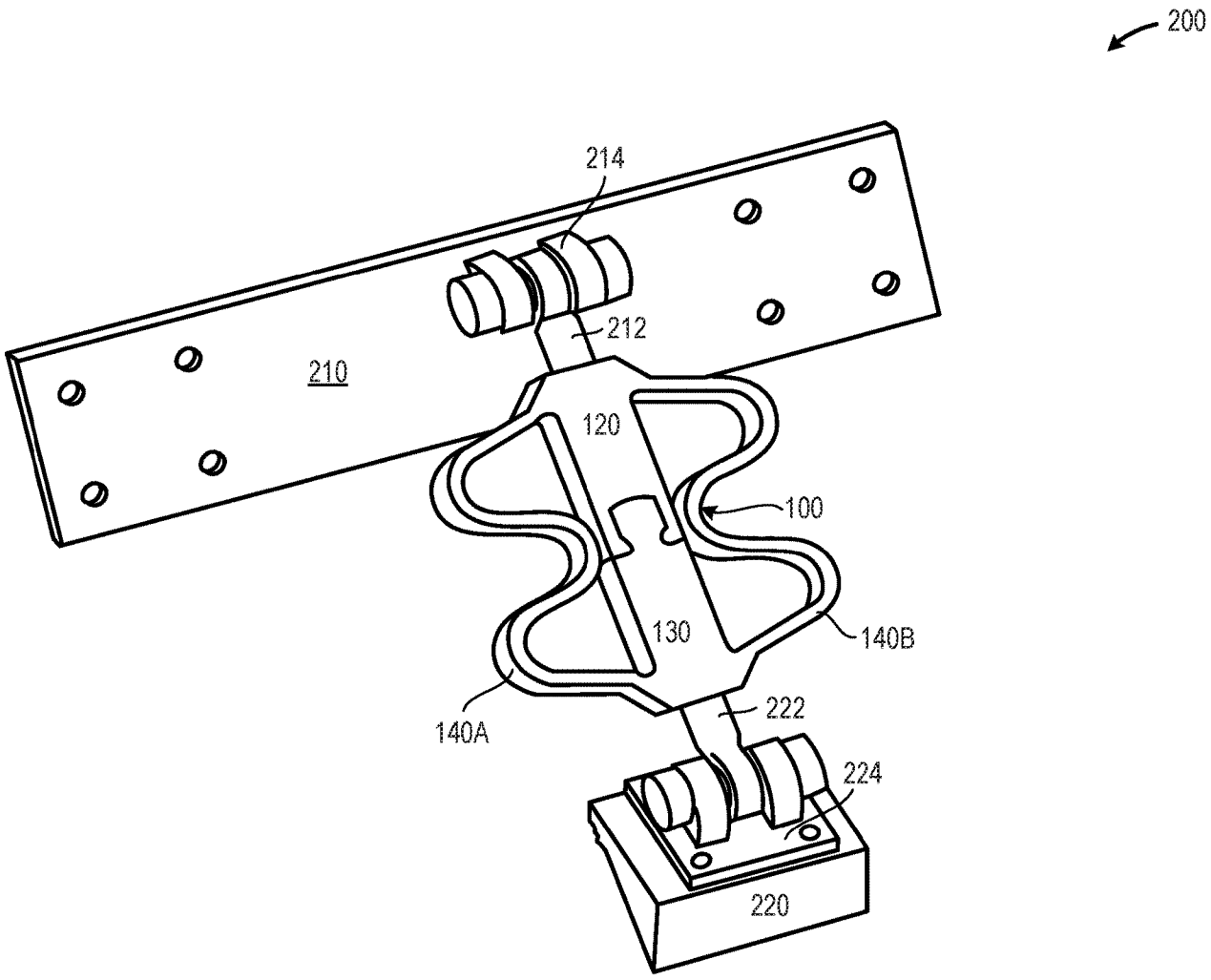
FIG. 2 is a perspective view of a system that includes an illustrative interference damper coupled to a vehicle exterior hull and to a vehicle floor, in accordance with at least one embodiment described herein.

Although the following Detailed Description will proceed with reference being made to illustrative embodiments, many alternatives, modifications and variations thereof will be apparent to those skilled in the art.

DETAILED DESCRIPTION

The systems and methods disclosed herein provide an interference damper capable of dampening a force exerted a vehicle floor caused by an explosive device detonated proximate the vehicle. The interference damper includes a common member having a first breakaway member coupled to a second breakaway member. One or more deformable connection features disposed on the first breakaway member form a female connector that receives a complimentary male connector disposed on the second breakaway member. The first breakaway member may be coupled to a vehicle external hull and the second breakaway member may be coupled to a vehicle floor that is spaced apart from the vehicle external hull. Application of a sudden force on the vehicle external hull causes up upward movement of the vehicle hull while the vehicle floor remains stationary. The relative movement between the vehicle hull and the vehicle floor places the interference dampers in tension.

Application of a tensile force greater than a defined threshold value causes the deformation and subsequent separation of the first breakaway member and the second breakaway member at the connection between the breakaway members. After separation of the first breakaway member from the second breakaway member, a plurality of curved members coupled to the first breakaway member and the second breakaway member reduce the acceleration of the first breakaway member from the second breakaway member. A first end of a first curved member couples to the first breakaway member and a second end of the first curved member couples to the second breakaway member. A first end of a second curved member couples to the first breakaway member and a second end of the second curved member couples to the second breakaway member.

Upon separation of the first breakaway member from the second breakaway member, the first and the second curved members provide a gradually increasing resistive force that slows the acceleration of the first breakaway member from the second breakaway member. Thus, the interference damper beneficially provides both a defined yield point at which the first breakaway member separates from the second breakaway member and a defined deceleration after separation of the first breakaway member from the second breakaway member. The capability of defining a separation force beneficially permits the selection/design of the female/male connection between the first breakaway member and the second breakaway member such that routine operation of the vehicle (e.g., bumps and jostling over rugged terrain and/or unimproved roads) does not cause a separation of the first breakaway member from the second breakaway member. Subsequent to the separation of the of the first breakaway member from the second breakaway member, the first curved member and the second curved member beneficially provide a defined resistive deceleration force capable of reducing the acceleration the first breakaway member from the second breakaway member.

A typical application for such an interference damper may include a military vehicle having an outer hull and an inner cargo and/or personnel floor that is separated by a distance or spaced apart from the outer hull of the vehicle. The first breakaway member may be coupled to the external hull and the second breakaway member may be coupled to the personnel/cargo floor. Application of an upward directed force on the external hull displaces the hull with respect to the floor places a tensile force on connection between the first breakaway member and the second breakaway member. If the force applied to the external hull is greater than the yield point of the connection between the first breakaway member and the second breakaway member, the connection separates and the first breakaway member accelerates away from the second breakaway member. Upon separation of the breakaway members, the first and second curved members slow the acceleration of the hull and reduce the force exerted on the vehicle floor (and consequently, the personnel and/or cargo carried on the floor of the vehicle).

A vehicular energy absorption system is provided. The absorption system may include: a first breakaway member having a first end and a second end, the first end including a first attachment feature and the second end couplable to an vehicle external hull and a second breakaway member having a first end and a second end, the first end including a second attachment feature complimentary to the first attachment feature to permit the operable coupling of the second breakaway member to the first breakaway member and the second end couplable to an internal vehicle structure spaced apart from the vehicle external hull. The system may further include: a first curved member having a first end and a second end, the first end of the first curved member affixed proximate the second end of the first breakaway member and the second end of the first curved member affixed proximate the second end of the second breakaway member; and a second curved member having a first end and a second end, the first end of the second curved member affixed proximate the second end of the first breakaway member and the second end of the second curved member affixed proximate the second end of the second breakaway member.

A vehicle is provided. The vehicle may include: an external vehicle hull, a vehicle floor spaced apart from the external vehicle hull, and an energy absorption system pivotably coupled to the external vehicle hull and pivotably coupled to the vehicle floor. The energy absorption system may include: a first breakaway member having a first end and a second end, the first end including a first attachment feature and the second end pivotably couplable to the external vehicle hull and a second breakaway member having a first end and a second end, the first end including a second attachment feature complimentary to the first attachment feature to permit the operable coupling of the second breakaway member to the first breakaway member and the second end of the second breakaway member pivotably couplable to the vehicle floor. The energy absorption system may additionally include: a first curved member having a first end and a second end, the first end of the first curved member affixed proximate the second end of the first breakaway member and the second end of the first curved member affixed proximate the second end of the second breakaway member and a second curved member having a first end and a second end, the first end of the second curved member affixed proximate the second end of the first breakaway member and the second end of the second curved member affixed proximate the second end of the second breakaway member.

A method of forming an energy absorption system is provided. The method may include: detachably attaching a first end of a first breakaway member to a first end of a second breakaway member to form a common member, coupling a first end of a first curved member proximate a second end of the first breakaway member and a second end of the first curved member proximate a second end of the second breakaway member, and coupling a first end of a second curved member proximate the second end of the first breakaway member and a second end of the second curved member proximate the second end of the second breakaway member. The first curved member and the second curved member may be disposed 180° opposed about a perimeter of the common member.

As used herein, the term "vehicle external hull" includes any external structure of a vehicle or any appurtenances or additional features coupled to an external structure of a vehicle upon which an externally applied force may act. The vehicle external hull may thus include, without limitation, a vehicle bottom and/or equipment or structures attached, coupled or affixed to the vehicle bottom; a vehicle side and/or equipment or structures attached, coupled or affixed to the vehicle side; a vehicle top and/or equipment or structures attached, coupled or affixed to the vehicle top.

FIG. 1A is an elevation of an illustrative interference damper 100 having a central member 110 that includes a first breakaway member 120 connected to a second breakaway member 130, a first curvedcurved member 140A coupled to the central member 110 and a second curvedcurved member 140B coupled to the central member 110, in accordance with at least one embodiment described herein. Preferably, the first curved member 140A and second curved member 140B are as illustrated in FIG. 1A, a compound curve that has a central curve 142A, 142B (respectively) that is convex relative to the central member 110. FIG. 1B is a plan view of the illustrative interference damper 100 depicted in FIG. 1A along sectional line 1B-1B, in accordance with at least one embodiment described herein. FIG. 1C is an enlarged view of the connection or coupling between the first breakaway member 120 and the second breakaway member 130, in accordance with at least one embodiment described herein.

The central member 110 includes a first breakaway member 120 coupled or connected to a second breakaway member 130. In embodiments, the first breakaway member 120 and the second breakaway member 130 may lie along a common longitudinal axis 150. The connection between the first breakaway member 120 and the second breakaway member 130 permits the displacement of the first breakaway member 120 with respect to the second breakaway member 130 upon application of a tensile force on the central member 110. As depicted in FIG. 1A, the first breakaway member 120 may incorporate or include a female connector 122 to receive a complimentary male connector 132 incorporated or included on the second breakaway member 130.

In embodiments, the first breakaway member 120 may include a female connector 122 that includes a plurality of projecting members 124A and 124B that form a void space having a first portion with a relatively wide first dimension 134 and a second portion having a relatively narrow second dimension 136. In embodiments, the second breakaway member 130 may include a male connector 132 that includes a first portion having a relatively wide first dimension complimentary to the first dimension 134 of the female connector 122 and second portion having a relatively narrow second dimension complimentary to the second dimension 136 of the female connector 122. In some implementations, the central member 110 may include a unitary member that is cut to form the first breakaway member 120 interlocked with the second breakaway member 130. In some implementations, the first breakaway member 120 and the second breakaway member 130 may be formed separately and the male connector 132 on the second breakaway member 130 slideably inserted into the female connector 122 on the first breakaway member 120.

Although depicted in FIGS. 1A, 1B, and 1C as fabricated using flat plate, the central member 110 may be fabricated using round stock, bar stock or similar material. Further, although the female connector 122 on the first breakaway member 120 is depicted as having two, 180 degree opposed, elements 124A and 124B, any number and/or configuration of elements may be similarly configured. Thus, the female connector 122 may include three elements 124A-124C spaced at or separated by 120 degrees, 4 elements 124A-124D spaced at or separated by 90 degrees, or any number of regular irregular spaced or positioned elements 124A-124*n*. In the foregoing, elements 124C, 124D and 124*n* are not shown for clarity purposes. The size, shape, and geometry of the elements may be determined based at least in part on a defined force at which the elements 124A-124*n* permit the separation of the first breakaway member 120 from the second breakaway member 130.

Although the female connector 122 and male connector 132 are depicted in FIGS. 1A, 1B and 1C as a "key" or rectangular shape for clarity and ease of discussion, one of ordinary skill in the art will readily appreciate that other connector shapes and/or geometries may be used and thus should also be considered as included in the scope of this disclosure. Generally, any female connector 122/male connector 132 configuration and/or geometry having a defined yield point at which the first breakaway member 120 separates from the second breakaway member 130 may be used. For example, polygonal, circular, oval, and similar connector geometries may be substituted. The yield point may fall in the range of 4,000 pounds of tensile force to 10,000 pounds of tensile force placed upon the interference damper 100.

The first curvedcurved member 140A and the second curvedcurved member 140B may be fabricated integral with the central member 110. In embodiments, the curvedcurved members 140A and 140B are fabricated integral with the central member 110. In other embodiments, the curvedcurved members 140A and 140B may be fabricated separate from the central member 110 and bonded or otherwise affixed to the central member 110. Each of the curvedcurved members 140A and 140B have a first end that is formed integral with or otherwise affixed to the first breakaway member 120 and a second end that is integral with or otherwise affixed to the second breakaway member 130. The configuration of the curvedcurved members 140A and 140B provide a gradually increasing resistive force as the separation distance between the first breakaway member 120 and the second breakaway member 130 increases.

The first breakaway member 120 may include a recess or similar attachment feature 128 to permit the coupling of a first end of the interference damper 100 to a vehicle external hull or to a vehicle floor. In embodiments, the attachment feature 128 may include a threaded attachment feature 128. In other embodiments, the attachment feature 128 may include a smooth attachment feature in which an attachment member may be at least partially inserted and/or affixed, for example via welding. The second breakaway member 130 may also include a recess or similar attachment feature 138 to permit the coupling of a second end of the interference damper 100 to a vehicle external hull or to a vehicle floor. In embodiments, the attachment feature 138 may include a threaded attachment feature 128. In other embodiments, the attachment feature 138 may include a smooth attachment feature in which an attachment member may be at least partially inserted and/or affixed, for example via welding.

In embodiments, the interference damper 100, including the central member 110 and the first and second curvedcurved members 140A and 140B may be fabricated from a single member, for example, the interference damper 100 may be laser, plasma, or waterjet cut from a single sheet of material, such as carbon steel, 304 stainless steel, or 316 stainless steel. In instances where the interference damper 100 is cut from a single sheet of material, the thickness of the material may be selected based upon on the desired yield point (e.g., tensile force) of the interference damper 100. In embodiments, the interference damper 100 may be cut from sheet material having a thickness of: less than or equal to about 0.25 inches (in); less than or equal to about 0.50 in; less than or equal to about 0.75 in; less than or equal to about 1.00 in; less than or equal to about 1.25 in; or less than or equal to about 1.50 in. In embodiments, the interference damper 100 may be cut from sheet material having a yield strength of: less than or equal to about 10,000 psi; less than or equal to about 20,000 pounds per square inch (psi); less than or equal to about 30,000 psi; less than or equal to about 40,000 psi; or less than or equal to about 50,000 psi. The first breakaway member 120 may be fabricated integrally with the second breakaway member 130 and the curved members 140A, 140B. In embodiments, the first breakaway member 120 may include a member having physical geometry, size, and/or shape to provide a connection with the second breakaway member 130 that fails at a defined tensile force and the breakaway members 120, 130 separate. In one or more embodiments, the first breakaway member 120 may have a width of: less than or equal to about 0.50 inches (in); less than or equal to about 1.00 in; less than or equal to about 1.25 in; less than or equal to about 1.5 in; or less than or equal to about 2.00 in. In one or more embodiments, the first breakaway member 120 may have a thickness of: less than or equal to about 0.25 inches (in); less than or equal to about 0.50 in; less than or equal to about 1.00 in; less than or equal to about 1.25 in; less than or equal to about 1.5 in; or less than or equal to about 2.00 in.

The first breakaway member 120 may include any number of elements 124A-124*n* to form the female attachment feature 122. In embodiments, the first breakaway member 120 may be fabricated using a material different from the material used to fabricate the second breakaway member 130. For example, the first breakaway member 120 may be fabricated using a material having a lower yield strength than the second breakaway member 130 to provide a common member 110 having a defined yield point at which the first breakaway member 120 separates from the second breakaway member 130. Each of the elements 124 may have the same or different physical geometry, size, and/or shape to provide a female attachment feature 122 that fails at a defined tensile or compressive force permitting the first breakaway member 120 to separate from the second breakaway member 130. In embodiments, the elements 124 forming the female attachment feature 122 may extend from a first end of the first breakaway member 120. In embodiments, the elements 124 forming the female attachment feature 122 may extend from the first end of the first breakaway member 120 in a direction generally parallel to the longitudinal axis 150 of the central member 110. In embodiments, the elements 124 forming the female attachment feature 122 may extend from the first end of the first breakaway member 120 by: less than or equal to about 0.50 inches (in); less than or equal to about 0.75 in; less than or equal to about 1.00 in; less than or equal to about 1.25 in; or less than or equal to about 1.50 in.

In embodiments, the elements 124 forming the female attachment feature 122 may have an "L" shaped profile in which a first portion of each element 124A, 124B has a relatively small first width 125A, 125B (respectively) and a second portion of the element 124 has a relatively large second width 126A, 126B (respectively). The second portion of the element 124 may engage a corresponding recess on the male attachment feature 132 disposed or otherwise formed on a first end of the second breakaway member 130. The first portion of each element 124A-124*n* forming the female attachment feature 122 may have a relatively small first width of: less than or equal to about 0.50 inches (in); less than or equal to about 0.40 in; less than or equal to about 0.30 in; less than or equal to about 0.20 in; or less than or equal to about 0.10 in. For example, the first portion of each element 124 forming the female attachment feature 122 may have a relatively small first width of about 0.10 inches to 0.50 inches. The second portion of each element 124 forming the female attachment feature 122 may have a relatively large second width of: less than or equal to about 0.50 inches (in); less than or equal to about 0.40 in; less than or equal to about 0.30 in; less than or equal to about 0.20 in. For example, the second portion of each element 124 forming the female attachment feature 122 may have a relatively large second width of about 0.20 inches to 0.50 inches, provided that it is larger than the first portion of the female attachment element 124. The female attachment feature 122 may include any number of elements 124A-124*n*. Although depicted as two, 180° opposed elements in FIGS. 1A, 1B, and 1C any number of elements 124A-124*n* may be evenly or unevenly spaced about the perimeter of the first breakaway member 120. Although depicted as the same thickness as the first breakaway member 120 in FIGS. 1A, 1B, and 1C, the elements 124A-124*n* may have the same or a different thickness than the first breakaway member 120.

The second breakaway member 130 includes a male attachment feature 132 that is complimentary to the female attachment feature 122 on the first breakaway member 120. As depicted in FIGS. 1A, 1B, and 1C, the male attachment feature 132 may have a first portion having a relatively large width 134 that corresponds to the relatively small first portion of elements 124A-124*n* forming female attachment feature 122 and a second portion having a relatively small width 136 that corresponds to the relatively large second portion of elements 124A-124*n* forming female attachment feature 122.

The first portion of the male attachment feature 132 may have a relatively large first width 134 of: less than or equal to about 1.25 inches (in); less than or equal to about 1.00 in; less than or equal to about 0.75 in; less than or equal to about 0.50 in; or less than or equal to about 0.25 in. For example, the first portion of the male attachment feature may have a width 134 of about 0.25 inches to 1.25 inches. The second portion of the male attachment feature 132 may have a relatively small second width 136 of: less than or equal to about 0.50 inches (in); less than or equal to about 0.40 in; less than or equal to about 0.30 in; less than or equal to about 0.20 in. For example, the second portion of the male attachment feature 132 may have a width 136 of about 0.20 inches to 0.50 inches, provided it is smaller than the first portion of the male attachment feature 132. Although depicted as the same thickness as the second breakaway member 130 in FIGS. 1A, 1B, and 1C, the male attachment feature 132 may have the same or a different thickness than the second breakaway member 130.

The first curved member 140A may have any number of arced or arched portions, and as noted above, is preferably a compound curve meaning that it has a central curve 142A that is convex relative to the central member 110. For example, as depicted in FIGS. 1A, 1B, and 1C, the first curved member 140A may include 3 arcs of from about 150° to about 180°. In embodiments, the first curved member 140A may be fabricated integral with the central member 110. For example, the first curved member 140A may be cut from a single sheet of material along with the central member. The first end of the first curved member 140A is formed integral with or affixed to a second end of the first breakaway member 120 (i.e., the end of the first breakaway member 120 opposite the connection with the second breakaway member 130). The second end of the curved member 140A is formed integral with or affixed to a second end of the first breakaway member 120 (i.e., the end of the second breakaway member 130 opposite the connection with the first breakaway member 120). In embodiments, the number, location, and radii of the arced or arched portions of the first curved member 140A may be the same or different. In embodiments, the number, location, and radii of the arced or arched portions of the first curved member 140A may be selected based upon a defined elongation force range.

The first curved member 140A may extend any distance from the surface of the central member 110. In embodiments, the first curved member 140A may extend from the surface of the central member 110 a distance of: less than or equal to about 4.0 inches (in); less than or equal to about 3.5 in; less than or equal to about 3.0 in; less than or equal to about 2.5 in; less than or equal to about 2.0 in; less than or equal to about 1.5 in; or less than or equal to about 1.0 in. For example, the first curved member 140A may extend from the surface of the central member 110 a distance of about 1.0 inches to 4.0 inches. The curved portions of the first curved member 140A may have any radius. In embodiments, the curved portions of the first curved member 140A may have a radius of: less than or equal to about 1.00 inches (in); less than or equal to about 0.75 in; less than or equal to about 0.60 in; less than or equal to about 0.50 in; or less than or equal to about 0.40 in. For example, the curved portions of the first circular member 140A may have a radius of about 0.40 inches to 1.00 inches. The first curved member 140A may have any width selected, based at least in part, on a defined force to elongate the first curved member 140A after the first breakaway member 120 separates from the second breakaway member 130. In embodiments, the first curved member 140 may have a width of: less than or equal to about 0.50 inches (in); less than or equal to about 0.40 in; less than or equal to about 0.30 in; less than or equal to about 0.20 in; or less than or equal to about 0.10 in. For example, the first curved member 140A may have a width of about 0.10 inches to about 0.50 inches. Although depicted as the same thickness as the central member 110 in FIGS. 1A, 1B, and 1C, the first curved member 140A may have the same or a different thickness than the central member 110.

The second curved member 140B may have any number of arced or arched portions or segments, and as noted above, is preferably a compound curve meaning that it has a central curve 142B that is convex relative to the central member 110. The second curved member 140B may be symmetric or asymmetric to the first curved member 140A. For example, as depicted in FIGS. 1A, 1B, and 1C, the second curved member 140B may include 3 arcs of from about 150° to about 180°. In embodiments, the second curved member 140B may be fabricated integral with the central member 110. For example, the second curved member 140B may be cut from a single sheet of material along with the central member 110 and the first curved member 140A. The first end of the second curved member 140B is formed integral with or affixed to a second end of the first breakaway member 120 (i.e., the end of the first breakaway member 120 opposite the connection with the second breakaway member 130). The second end of the second curved member 140B is formed integral with or affixed to a second end of the first breakaway member 120 (i.e., the end of the second breakaway member 130 opposite the connection with the first breakaway member 120). The number, location, and radii of the arced or arched portions of the second curved member 140B may be the same or different. In embodiments, the number, location, and radii of the arced or arched portions of the second curved member 140B may be selected based upon a defined elongation force range.

The second curved member 140B may extend any distance from the surface of the central member 110. In embodiments, the second curved member 140B may extend from the surface of the central member 110 a distance of: less than or equal to about 4.0 inches (in); less than or equal to about 3.50 in; less than or equal to about 3.00 in; less than or equal to about 2.50 in; less than or equal to about 2.00 in; less than or equal to about 1.50 in; or less than and equal to about 1.00 in. For example, the maximum distance between the arced or arched portion of the second curved member 140B and the surface of the central member 110 may be about 1.0 inches to 4.0 inches. The curved, arced, or arched portions of the second curved member 140B may have any radius of curvature. In embodiments, the curved, arced, or arched portions of the second curved member 140B may have a radius of: less than or equal to about 1.00 inches (in); less than or equal to about 0.75 in; less than or equal to about 0.60 in; less than or equal to about 0.50 in; or less than or equal to about 0.40 in. For example, the curved, arced, or arched portions of the second curved member 140B may have a radius of about 0.40 inches to 1.00 inches. The second curved member 140B may have any width selected, based at least in part, on a defined force to elongate the second curved member 140B after the first breakaway member 120 separates from the second breakaway member 130. In embodiments, the second curved member 140B may have a width of: less than or equal to about 0.50 inches (in); less than or equal to about 0.40 in; less than or equal to about 0.30 in; less than or equal to about 0.20 in; or less than or equal to about 0.10 in. For example, the second curved member 140B may have a width of about 0.10 inches to 0.50 inches. Although depicted as the same thickness as the central member 110 in FIGS. 1A, 1B, and 1C, the second curved member 140B may have the same or a different thickness than the central member 110.

The first and the second curved members 140A and 140B provide a gradually increasing resistance to the elongation of the interference damper 100 after separation of the first breakaway member 120 from the second breakaway member 130. The first and the second curved members 140A and 140B provide a gradually increasing resistance to elongation that is based, at least in part, on the separation distance between the first breakaway member 120 and the second breakaway member 130. The resistance of the first and the second curved member 140A and 140B may range from: about 500 pounds force ($lb_f$) to about 15,000 $lb_f$; about 1,000 $lb_f$ to about 12,500 $lb_f$; about 1,500 $lb_f$ to about 11,000 $lb_f$; about 1,750 $lb_f$ to about 10,000 $lb_f$; or about 2,000 $lb_f$ to about 9,000 $lb_f$. The first and the second curved members 140A and 140B provide a resistance to elongation of the interference damper 100 that varies based on the separation distance between the first breakaway member 120 and the second breakaway member 130. The first and the second curved members 140A and 140B provide a resistance to elongation of the interference damper 100 that varies based on a distance between the first breakaway member 120 and the second breakaway member 130 of: up to about 12.0 inches (in); up to about 10.0 in; up to about 8.0 in; up to about 6.0 in; or up to about 5.0 in. The distance between the first breakaway member 120 and the second breakaway member 130 may therefore fall in the range of 5.0 inches to 12.0 inches. The first and the second curved members 140A and 140B may be fabricated using a material that is the same as or different from the central member 110.

FIG. 2 is a perspective view of a system 200 that includes an illustrative interference damper 100 coupled to a vehicle exterior hull 210 and to a vehicle floor 220, in accordance with at least one embodiment described herein. In embodiments, any number of interference dampers 100 may operably couple the vehicle external hull 210 to the vehicle floor 220. As depicted in FIG. 2, a first connecting member 212 may be coupled to the first attachment feature 128 in the first breakaway member 120 and a second connecting member 222 may be coupled to the second attachment feature 138 in the second breakaway member 130. The first connecting member 212 may be moveably or pivotably coupled 214 to the vehicle exterior hull 210. The second connecting member 222 may be moveably or pivotably coupled 224 to the vehicle floor 220. As depicted in FIG. 2, an externally applied force may drive the vehicle external hull 210 upward while the vehicle floor 220 remains relatively stationary, thereby placing the interference damper 100 in tension. If the force applied to the vehicle external hull 210 is sufficient to cause a separation of the first breakaway member 120 from the second breakaway member 130, the two curved members 140A, 140B decelerate the hull, reducing the force applied to the cargo or personnel in contact with the vehicle floor 220.

Figure 3:
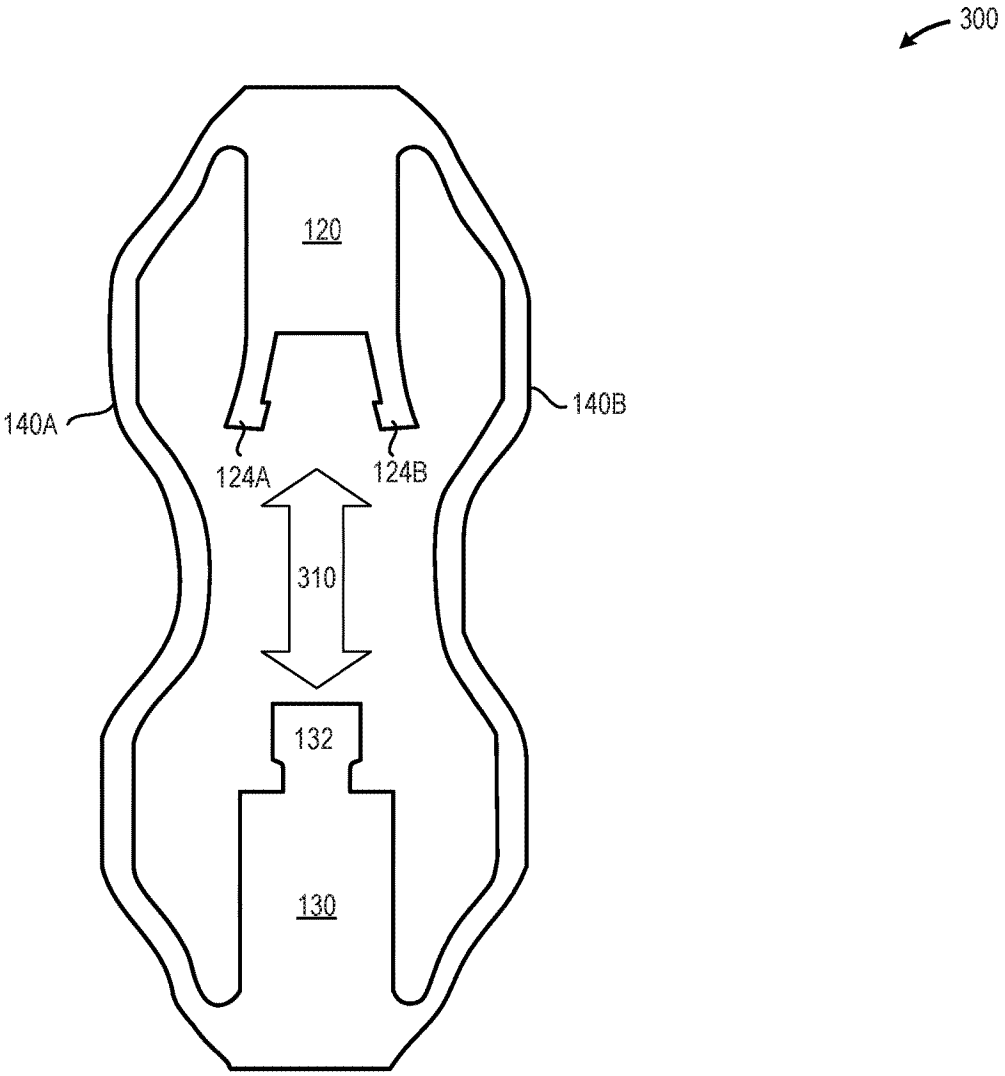
FIG. 3 is an elevation view of an illustrative interference damper after the first breakaway member separates from the second breakaway member as a result of a tensile force applied to the interference damper 100, in accordance with at least one embodiment described herein.

FIG. 3 is an elevation view of an illustrative interference damper 100 after separation of the first breakaway member 120 from the second breakaway member 130 as a result of a tensile force 310 applied to the interference damper 100, in accordance with at least one embodiment described herein. As depicted in FIG. 3, upon application of sufficient force 310, the projecting members 124A, 124B deform and the first breakaway member 120 separates from the second breakaway member 130. In embodiments, the mating surfaces between the projecting members 124 forming the female connector 122 and the male connector 132 may be configured to facilitate separation at a defined tensile force 310. For example, the mating surfaces may be sloped or curved to facilitate the separation of the first breakaway member 120 from the second breakaway member 130 at a defined tensile force 310.

Also as depicted in FIG. 3, upon separation of the first breakaway member 120 from the second breakaway member 130, the curved members 140 elongate to provide a gradually increasing resistive force to the separation. The curved members 140 therefore reduce the acceleration of the first breakaway member 120 with respect to the second breakaway member 130, thereby reducing the force exerted on the vehicle floor 220 coupled to the second breakaway member 130.

Figure 4:
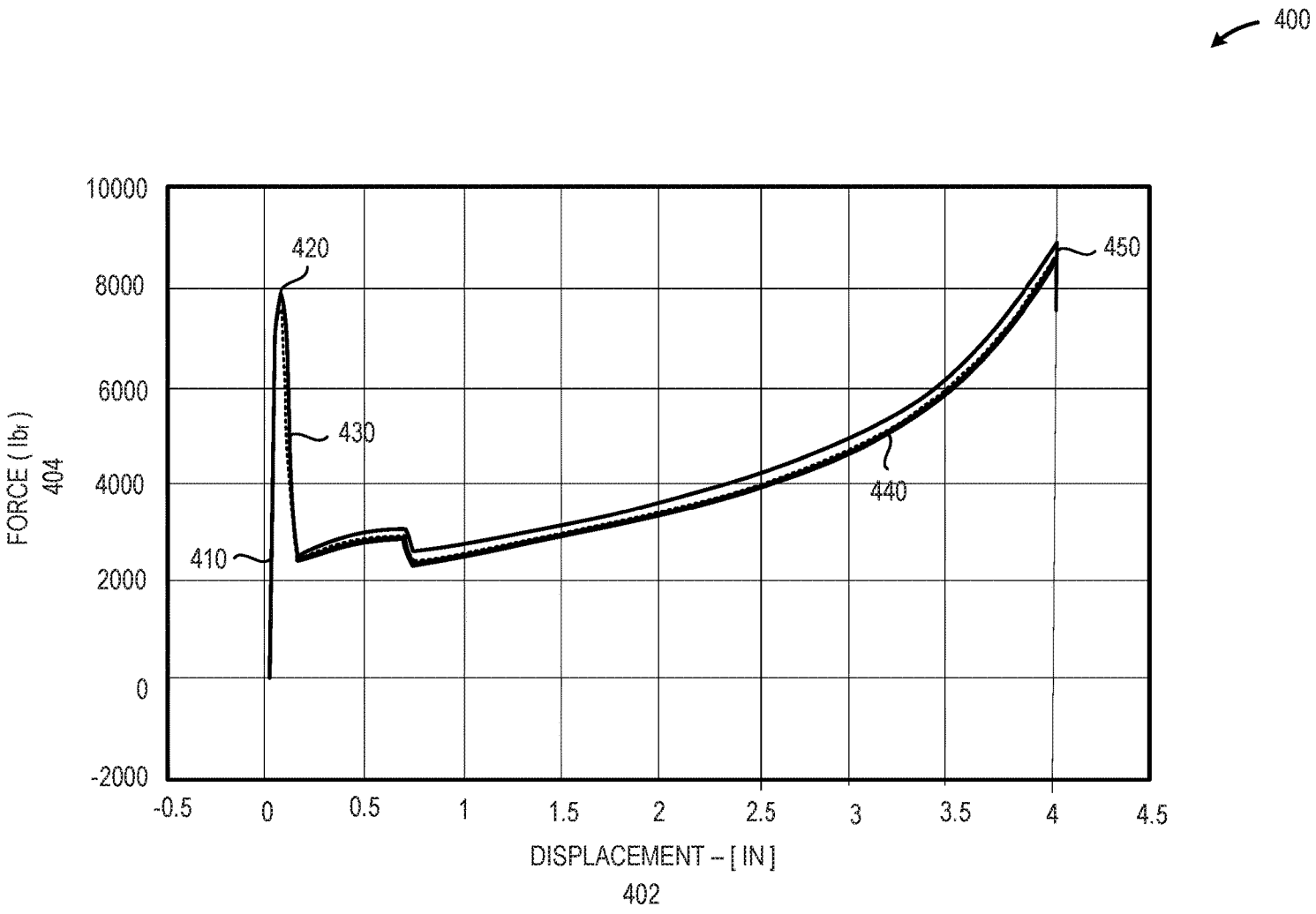
FIG. 4 is a chart depicting displacement (inches) as a function of force (pounds force) applied to an illustrative interference damper such as described above in FIGS. 1-3, in accordance with at least one embodiment described herein.

FIG. 4 is a chart 400 depicting displacement (in inches, in) 402 as a function of force (in pounds force, $lb_f$) 404 when applied to an illustrative interference damper 100 such as described above in FIGS. 1-3, in accordance with at least one embodiment described herein. The interference damper 100 begins at 406 with no applied force. At 410 a tensile force 410 is applied to the interference damper 100. As depicted in FIG. 4, the tensile force 410 begins at 0 $lb_f$ and increases to about 8,000 $lb_f$. The tensile force 410 is similar to the force applied by a detonation of a device proximate the vehicle exterior hull 210. The tensile force 410 increases until the yield point 420 of the common member 110. At the yield point 420, the projecting members 124A, 124B that form the female connector 122 on the first breakaway member 120 deform, allowing the first breakaway member 120 to separate from the second breakaway member 130.

The tensile force 430 decreases as the separation between the first breakaway member 120 and the second breakaway member 130 increases to about 0.25 inch. The first curved member 140A and the second curved member 140B gradually increase resistance as the separation between the first breakaway member 120 and the second breakaway member 130 increases from 0.25 inch to about 4 inches. The gradual increase in resistance caused by the first and the second curved members 140A, 140B slow the acceleration of the external vehicle hull 210 with respect to the vehicle floor 220, reducing the force applied to the vehicle floor 220 and to the cargo and/or personnel in contact with the vehicle floor 220.

Figure 5:
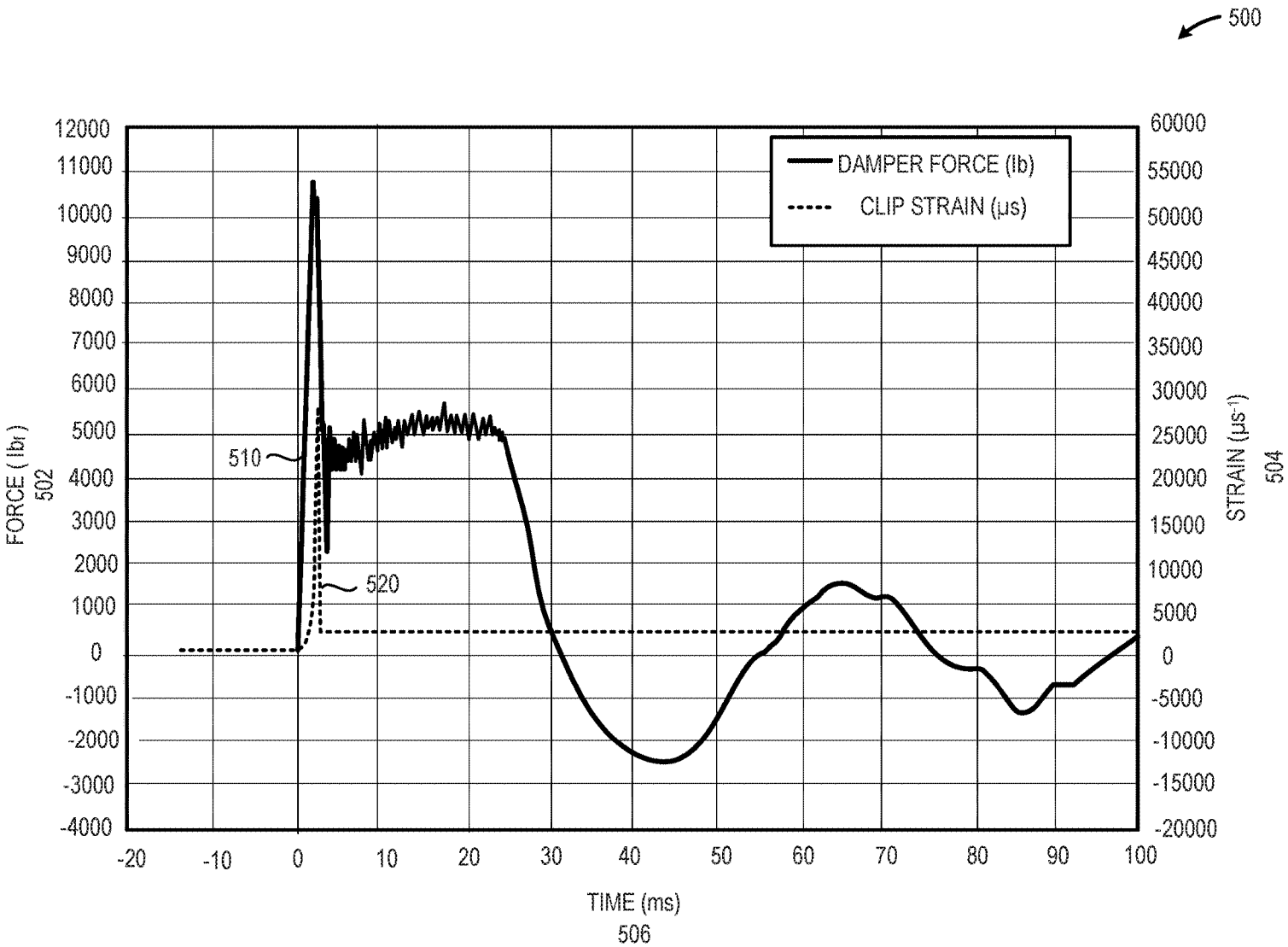
FIG. 5 is a chart depicting force (pounds force) applied during a drop tower test rig to an interference damper and strain (inverse microseconds) caused by the drop tower test rig on the common member of an interference damper as a function of time (milliseconds), in accordance with at least one embodiment described herein.

FIG. 5 is a chart 500 depicting force (pounds force, $lb_f$) 502 applied during a drop tower test rig to an interference damper 100 and strain (inverse microseconds, $\mu s^{-1}$) 504 caused by the drop tower test rig on the common member 110 of an interference damper 100 as a function of time (milliseconds, ms) 506, in accordance with at least one embodiment described herein. The drop test simulates the acceleration of the vehicle exterior hull during a blast event. The drop tower force curve 510 and strain curve 520 confirm the common member 110 fails only after the applied force exceeds a threshold value.

Figure 6:
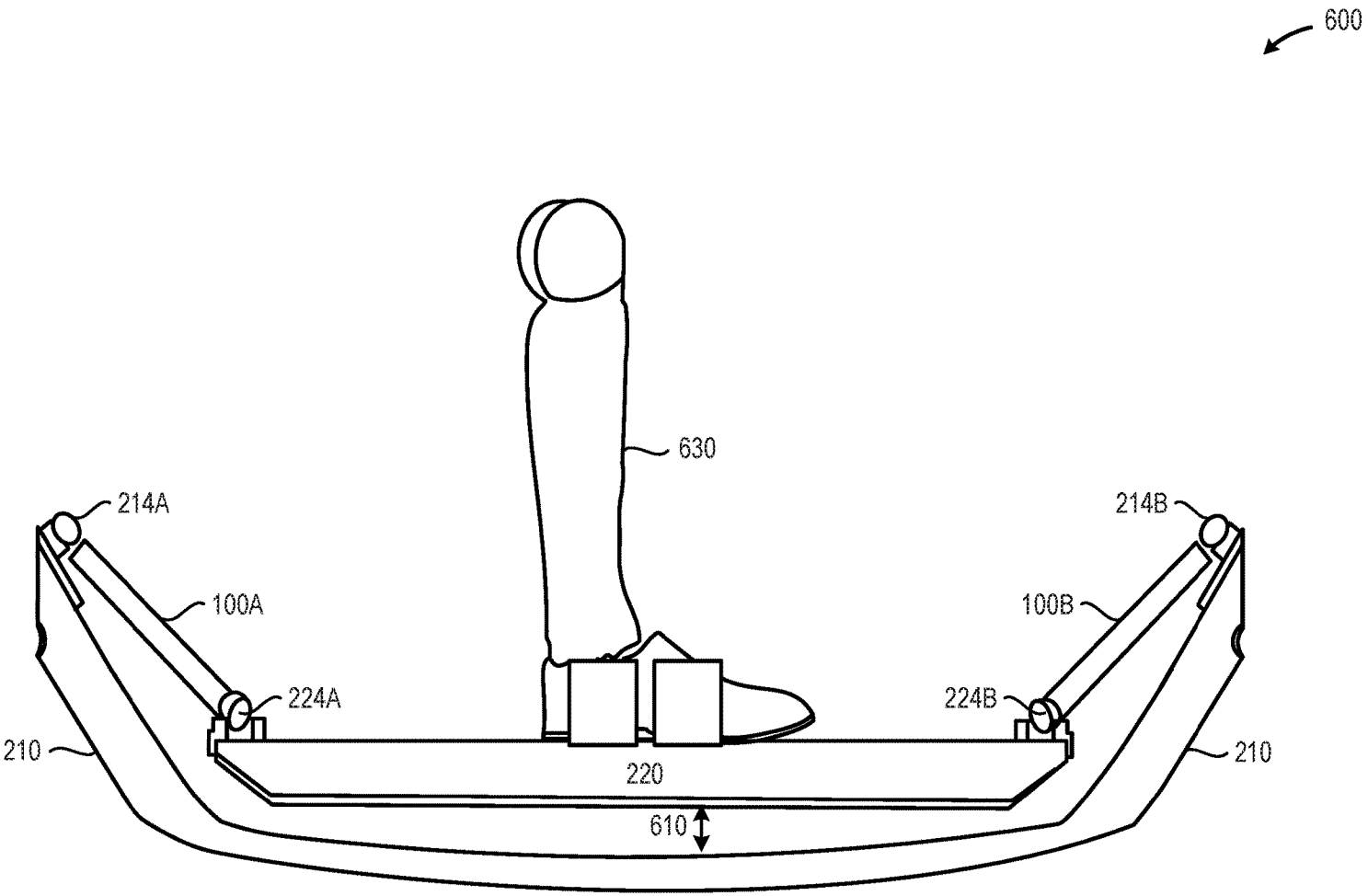
FIG. 6 depicts an illustrative system that includes a plurality of interference dampers that operably couple a vehicle external hull to a vehicle floor that supports personnel, in accordance with at least one embodiment described herein.

FIG. 6 depicts an illustrative system 600 that includes a plurality of interference dampers 100A, 100B that operably couple a vehicle external hull 210 to a vehicle floor 220 that supports personnel 630, in accordance with at least one embodiment described herein. As depicted in FIG. 6 the vehicle external hull 210 and the vehicle floor 220 may be separated by a distance 610. In embodiments, the separation distance between the vehicle external hull 210 and the vehicle floor 220 may be greater than the maximum separation distance between the first breakaway member 120 and the second breakaway member 130 that form the common member 110 in each of at least some of the plurality of interference dampers 100. Limbs (e.g., legs) of the personnel 630 transported by the vehicle may be in contact with the vehicle floor 220. Upon application of a force 620 to the vehicle external hull 210, the vehicle external hull 210 is forced upward while the vehicle floor remains relatively stationary. The plurality of interference dampers 100 act as "shock absorbers" to reduce the force transmitted via the vehicle floor 220 to the limbs 630 of the personnel inside the vehicle.

Figure 7:
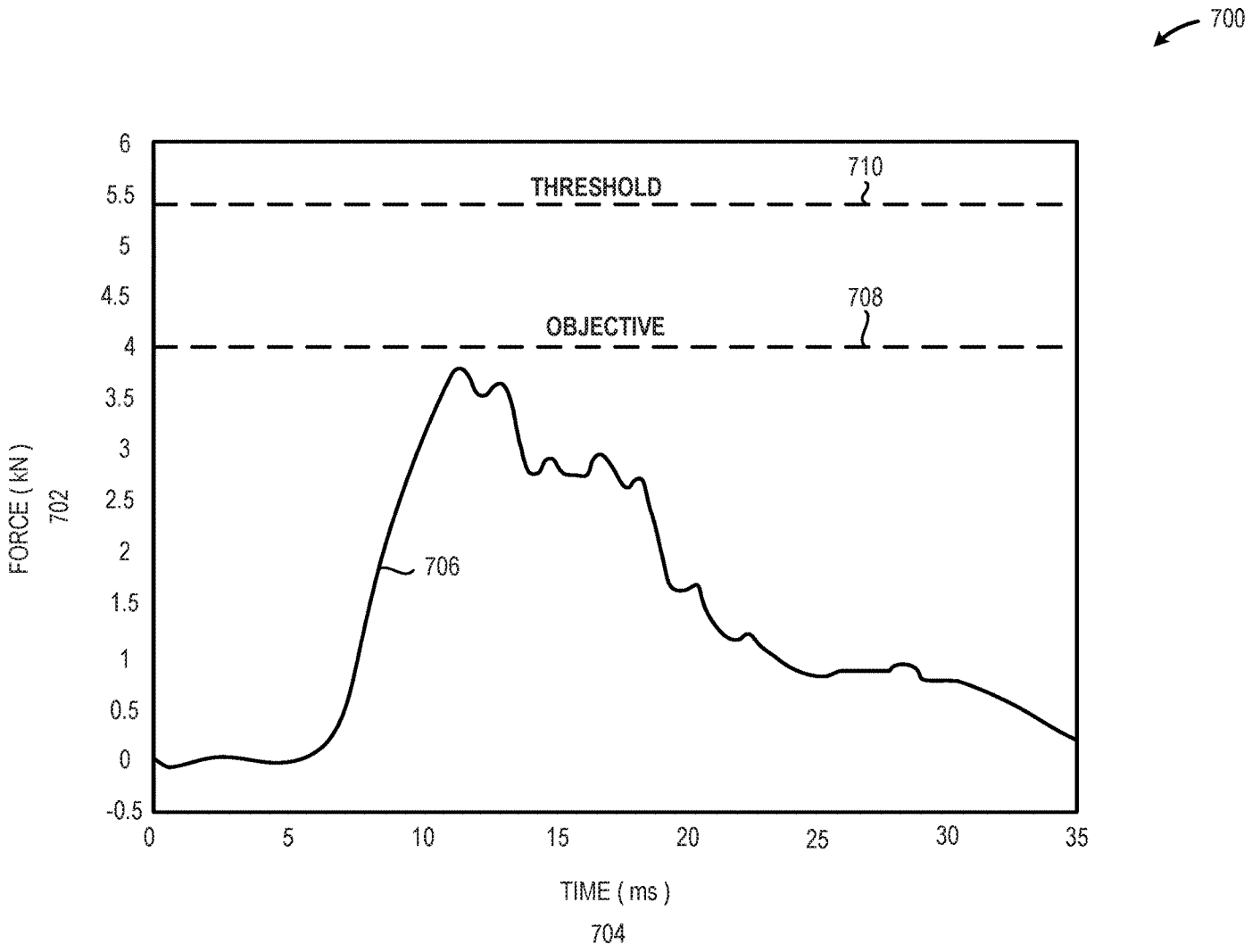
FIG. 7 is a chart depicting the force (kilonewtons) exerted on the legs of an occupant of a vehicle as a function of time (milliseconds), in accordance with at least one embodiment described herein.

FIG. 7 is a chart 700 depicting the force (kilonewtons, kN) 702 exerted on the legs of an occupant of a vehicle as a function of time (milliseconds, ms) 704, in accordance with at least one embodiment described herein. The threshold for damage to a vehicle occupant's tibia is represented by the "THRESHOLD" line 710 at about 5.5 kN. The target threshold for a vehicle having interference dampers 100 coupling the vehicle floor 220 to the vehicle external hull 210 is represented by the "OBJECTIVE" line 708 at approximately 4.0 kN. The objective threshold 708 corresponds to the $95^{th}$ percentile tibia injury for a human. The curve 706 depicts the force exerted on the tibia in a vehicle equipped with interference dampers 100 coupling the vehicle external hull 210 to the vehicle floor 220. The curve 706 remains below the $95^{th}$ percentile objective line 708 at all times.

Figure 8:
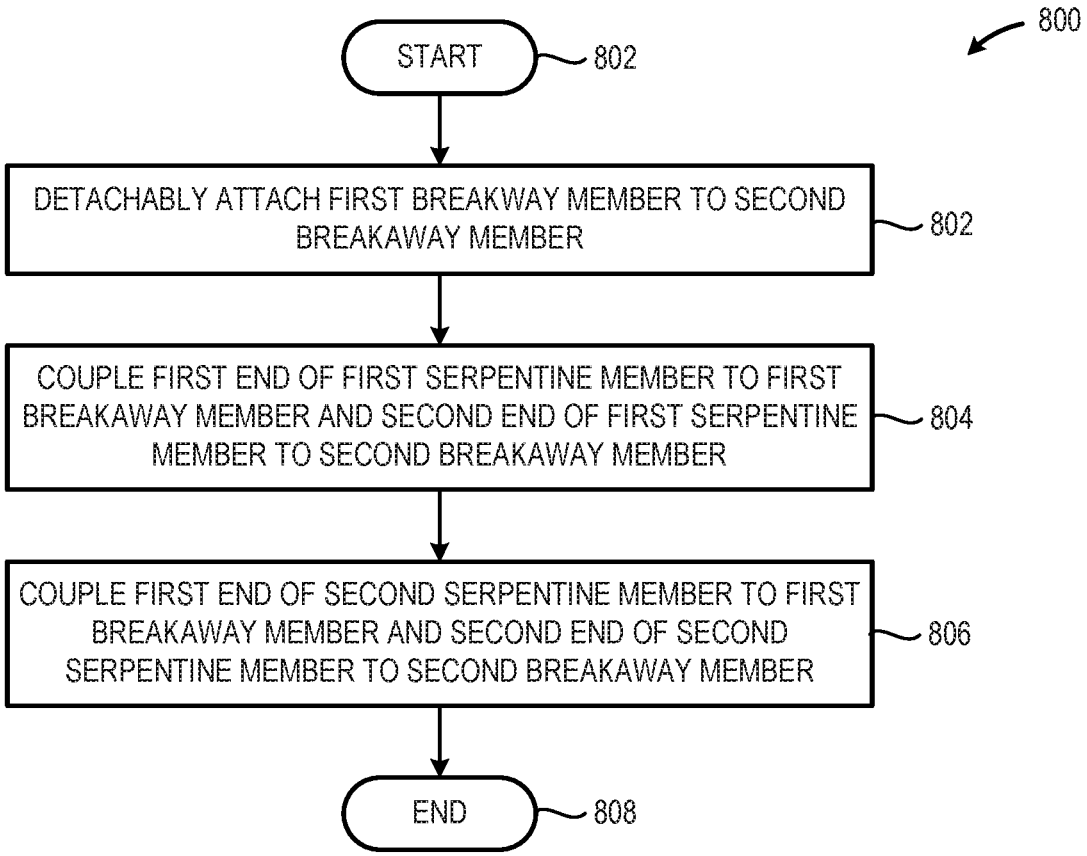
FIG. 8 is a flow diagram of an illustrative method of fabricating an interference damper 100, in accordance with at least one embodiment described herein.

FIG. 8 is a flow diagram of an illustrative method 800 of fabricating an interference damper 100, in accordance with at least one embodiment described herein. The interference damper 100 may include a common member 110 formed by the coupling of a first breakaway member 120 and a second breakaway member 130 with a first curved member 140A and a second curved member 140B coupled to the common member 110. The method commences at 802.

At 804, the first end of the first breakaway member 120 is coupled to the first end of the second breakaway member 130. In embodiments, the first breakaway member 120 may include a female connector 122 and the second breakaway member 130 may include a complimentary male connector 132. In embodiments. The first breakaway member 120 may include a plurality of projecting members 124A-124*n* that form the female connector 122. The first breakaway member 120 and the second breakaway member 130 together form the common member 110. In embodiments, a unitary body (e.g., a single piece of metal) may be laser, plasma, or water jet cut to form the common member 110 which is then pattern cut to form the first breakaway member 120 coupled to and/or connected with the second breakaway member 130. In other embodiments, the first breakaway member 120 and the second breakaway member 130 may be formed separately and joined, coupled, or connected during the fabrication process.

At 806, the first end of the first curved member 140A is coupled to the second end of the first breakaway member 120 and the second end of the first curved member 140A is coupled to the second end of the second breakaway member 130. In some embodiments, the first curved member 140A may be formed integral with either or both the first breakaway member 120 and the second breakaway member 130. In other embodiments, the first curved member 140A may be formed separate from the first breakaway member 120 and the second breakaway member 130 and may be affixed, attached, welded, or otherwise bonded to the first breakaway member 120 and the second breakaway member 130.

At 808, the first end of the second curved member 140B is coupled to the second end of the first breakaway member 120 and the second end of the second curved member 140B is coupled to the second end of the second breakaway member 130. In some embodiments, the second curved member 140B may be formed integral with either or both the first breakaway member 120 and the second breakaway member 130. In other embodiments, the second curved member 140B may be formed separate from the first breakaway member 120 and the second breakaway member 130 and may be affixed, attached, welded, or otherwise bonded to the first breakaway member 120 and the second breakaway member 130. The method 800 concludes at 808.

Figure 9:
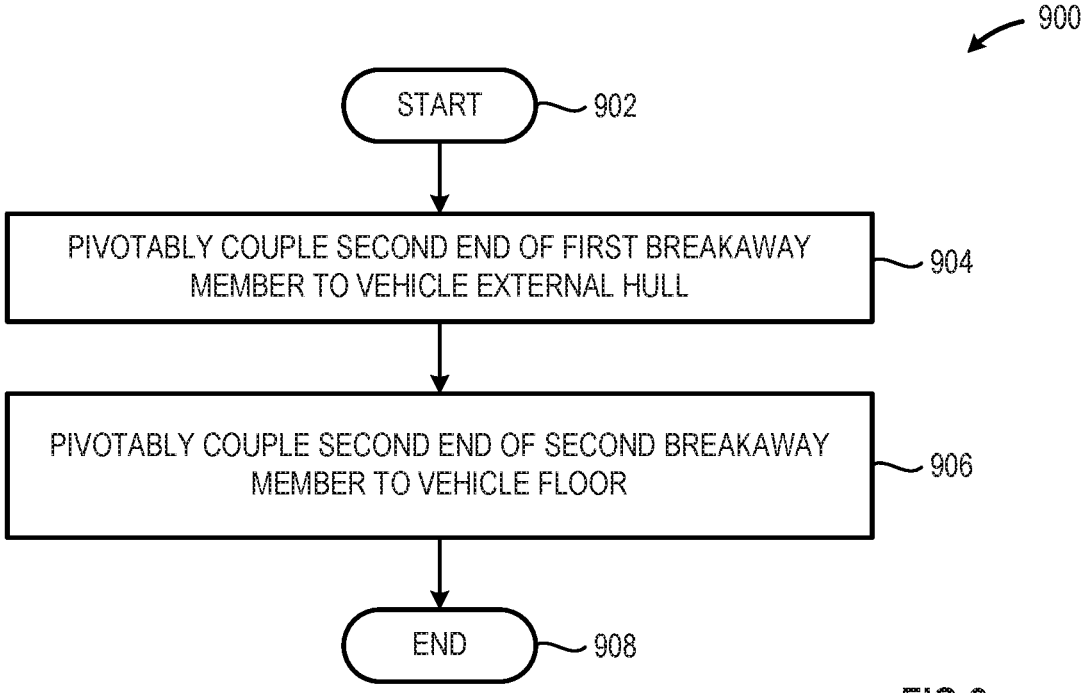
FIG. 9 is a flow diagram of an illustrative method of coupling a vehicle external hull to a vehicle floor using a plurality of interference dampers to reduce the forces exerted on the vehicle floor caused by an external force applied to the vehicle external hull, in accordance with at least one embodiment described herein.

FIG. 9 is a flow diagram of an illustrative method 900 of coupling a vehicle external hull 210 to a vehicle floor 220 using a plurality of interference dampers 100A-100*n* to reduce the forces exerted on the vehicle floor 220 caused by an external force 310 applied to the vehicle external hull 210, in accordance with at least one embodiment described herein. In embodiments, the vehicle floor 220 may be spaced apart from the vehicle external hull 210. In such instances, the interference dampers 100A-100*n* may couple the external vehicle hull 210 to the vehicle floor 220 to reduce the forces exerted on personnel and/or cargo in contact with the vehicle floor 220 upon application of a force 310 to the vehicle external hull 210. The connection between the first breakaway member 120 and the second breakaway member 130 may be configured to provide a defined yield point 420 (e.g., a defined yield point in $lb_f$) at which the first breakaway member 120 separates from the second breakaway member 130). The curved members 140 may be configured to provide a defined resistance to the separation of the first breakaway member 120 from the second breakaway member 130. Beneficially, the yield point at which the first breakaway member 120 separates from the second breakaway member 130 may be selected sufficiently high such that routine operation of the vehicle does not compromise the integrity of the interference damper 100 but application of a massive and/or sudden force to the vehicle external hull 210 is sufficient to exceed the yield point at which the first breakaway member 120 separates from the second breakaway member 130, to protect personnel and/or cargo in contact with the vehicle floor 220. The method 900 commences at 902.

At 904, the second end of the first breakaway member 120 is pivotably coupled to the vehicle external hull 210.

At 906, the second end of the second breakaway member 130 is pivotably coupled to the vehicle floor 220. The method 900 concludes at 908.

While FIGS. 8 and 9 illustrate vehicular force absorption system according to one or more embodiments, it is to be understood that not all of the operations depicted in FIGS. 8 and 9 may be necessary for other embodiments. Indeed, it is fully contemplated herein that in other embodiments of the present disclosure, the operations depicted in FIGS. 8 and 9, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

The systems and methods described herein provide a vehicular force absorption system that includes an interference damper that couples a vehicle external hull with a vehicle floor that is spaced apart from the vehicle external hull. The interference damper includes a common member having a first breakaway member coupled or connected to a second breakaway member. The coupling or connection between the first breakaway member and the second breakaway member may have a defined yield point at which the first breakaway member separates from the second breakaway member when subjected to a tensile force. The interference damper further includes a plurality of curved members that provide a resistive force against the separation of the first breakaway member and the second breakaway member. The resistive force provided by the interference damper beneficially reduces the force exerted on personnel and/or cargo in contact with the vehicle floor.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed is:

1. A vehicular energy absorption system, comprising:

a first breakaway member having a first end and a second end, the first end including a first attachment feature and the second end couplable to a vehicle external hull;

a second breakaway member having a first end and a second end, the first end including a second attachment feature complimentary to the first attachment feature to permit the operable coupling of the second breakaway member to the first breakaway member and the second end couplable to an internal vehicle structure spaced apart from the vehicle external hull;

a first curved member having a first end and a second end, the first end of the first curved member affixed proximate the second end of the first breakaway member and the second end of the first curved member affixed proximate the second end of the second breakaway member; and a second curved member having a first end and a second end, the first end of the second curved member affixed proximate the second end of the first breakaway member and the second end of the second curved member affixed proximate the second end of the second breakaway member;

wherein the first breakaway member, the second breakaway member, the first curved member, and the second curved member include a unitary structure formed by a single member.

2. The energy absorption system of claim 1 wherein the first curved member and the second curved member are affixed to the first breakaway member and to the second breakaway member at locations opposed by 180 degrees.

3. The energy absorption system of claim 1 wherein the first attachment feature comprises inward facing, 180° opposed, "L-shaped" members.

4. The energy absorption system of claim 1 wherein the vehicle external hull comprises an external vehicle hull.

5. The energy absorption system of claim 1 wherein the internal vehicle structure comprises a vehicle floor.

6. A vehicle, comprising:

an external vehicle hull;

a vehicle floor spaced apart from the external vehicle hull;

an energy absorption system pivotably coupled to the external vehicle hull and pivotably coupled to the internal vehicle floor, the energy absorption system including:

a first breakaway member having a first end and a second end, the first end including a first attachment feature and the second end pivotably couplable to the external vehicle hull;

a second breakaway member having a first end and a second end, the first end including a second attachment feature complimentary to the first attachment feature to permit the operable coupling of the second breakaway member to the first breakaway member and the second end of the second breakaway member pivotably couplable to the vehicle floor;

a first curved member having a first end and a second end, the first end of the first curved member affixed proximate the second end of the first breakaway member and the second end of the first curved member affixed proximate the second end of the second breakaway member; and a second curved member having a first end and a second end, the first end of the second curved member affixed proximate the second end of the first breakaway member and the second end of the second curved member affixed proximate the second end of the second breakaway member;

wherein the first breakaway member, the second breakaway member, the first curved member, and the second curved member include a unitary structure formed by a single member.

7. The vehicle of claim 6 wherein the first curved member and the second curved member are affixed to the first breakaway member and to the second breakaway member at locations opposed by 180 degrees.

8. The vehicle of claim 6 wherein the first attachment feature comprises inward facing, 180° opposed, "L-shaped" members.

9. A method of forming an energy absorption system, comprising:

cutting, from a single member, a unitary structure that includes:

a common member including:

a first breakaway member; and a second breakaway member, a first curved member; and a second curved member;

wherein a first end of a first breakaway member couples to a first end of a second breakaway member to form a common member;

wherein a first end of a first curved member attaches to a second end of the first breakaway member and a second end of the first curved member attaches to a second end of the second breakaway member;

wherein a first end of a second curved member attaches to the second end of the first breakaway member and a second end of the second curved member attaches to the second end of the second breakaway member; and wherein the first curved member and the second curved member are disposed 180° opposed about a perimeter of the common member.

10. The method of claim 9, further comprising:

pivotably coupling the second end of the first breakaway member to a vehicle external hull; and pivotably coupling the second end of the second breakaway member to a vehicle floor, the vehicle floor spaced apart from the vehicle external hull.

11. The method of claim 9:

wherein the first end of the first breakaway member includes an attachment feature and the first end of the second breakaway member includes a complimentary attachment feature; and wherein the attachment feature and the complimentary attachment feature detach when placed under a tensile force exceeding a first defined value.

12. The method of claim 9:

wherein the first end of the second curved member attaches to the second end of the first breakaway member in a location 180 degrees opposed to the first end of the first curved member; and wherein the second end of the second curved member attaches to the second end of the second breakaway member in a location 180 degrees opposed to the second end of the first curved member.

* * * * *